US006722333B2

(12) United States Patent
Kanno et al.

(10) Patent No.: US 6,722,333 B2
(45) Date of Patent: Apr. 20, 2004

(54) ENGINE CONTROL UNIT FOR SMALL WATERCRAFT

(75) Inventors: Isao Kanno, Shizuoka (JP); Hitoshi Motose, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 129 days.

(21) Appl. No.: 10/067,697

(22) Filed: Feb. 4, 2002

(65) Prior Publication Data

US 2002/0112694 A1 Aug. 22, 2002

(30) Foreign Application Priority Data

Feb. 2, 2001 (JP) ..... 2001-027045

(51) Int. Cl.[7] ..... F02N 17/00
(52) U.S. Cl. ..... 123/179.3; 440/85
(58) Field of Search ..... 123/406.53, 406.52, 123/179.5, 179.3, 198 DB, 198 DC, 339.1, 339.11, 339.14, 339.15; 440/85

(56) References Cited

U.S. PATENT DOCUMENTS 4,699,111 A * 10/1987 Yasuoka ..... 123/684
4,708,669 A 11/1987 Kanno et al.
4,850,318 A 7/1989 Torigai et al.
4,898,137 A 2/1990 Fujita et al.
4,909,764 A 3/1990 Hirukawa et al.
5,070,840 A 12/1991 Kanno et al.
5,715,793 A 2/1998 Motose
5,782,659 A 7/1998 Motose
5,937,825 A 8/1999 Motose
5,970,951 A 10/1999 Ito
6,508,680 B2 * 1/2003 Kanno ..... 440/1

FOREIGN PATENT DOCUMENTS

JP 59-170441 9/1984
JP 04-203224 7/1992
JP 05-280399 10/1993
JP 05-280400 10/1993

OTHER PUBLICATIONS

SeaDoo Shop Manual vol. 2, 2000, pp. 05–01–1, 05–01–1, 05–02–1, 05–02–2, 05–02–4, and 05–02–5.
Co–pending U.S. patent application No. 09/919,364, filed Jul. 31, 2001, entitled "Engine Control Arrangement for Four Stroke Watercraft" in 31 pages.
Co–pending U.S. patent application No. 09/708,900, filed Nov. 8, 2000, entitled "Marine Engine Control System" in 27 pages.

* cited by examiner

*Primary Examiner*—Tony M. Argenbright
*Assistant Examiner*—Arnold Castro
(74) *Attorney, Agent, or Firm*—Knobbe, Martens, Olson & Bear LLP

(57) ABSTRACT

A watercraft has a throttle position sensor, an engine speed sensor, and a start switch. The sensors communicate with a controller. The controller can regulate engine speed. The controller regulates or limits the engine to a low speed when the throttle angle is above a predetermined value during startup, and/or when the engine temperature is too low.

18 Claims, 6 Drawing Sheets

ENGINE CONTROL UNIT FOR SMALL WATERCRAFT

PRIORITY INFORMATION

This application is based on and claims priority to Japanese Patent Application No. 2001-027045, filed Feb. 2, 2001, the entire contents of which are hereby expressly incorporated by reference.

BACKGROUND OF THE INVENTION

1. Field of the Invention

The present application generally relates to an engine control unit, and more particularly, an engine management system that prevents excessive engine speed for a predetermined period of time after the engine has been started.

2. Description of the Related Art

Personal watercraft, like other applications that use internal combustion engines as power sources, are experiencing considerable public and governmental pressure to improve not only their performance, but also their exhaust emissions levels. For example, due to the emissions generated by two-stroke powered watercraft, certain recreational areas have banned the operation of such watercrafts. These bans have decreased the popularity of personal watercraft, and have caused manufacturers of these types of watercraft to consider fuel injected engines to power their watercraft and/or other means to reduce emissions levels.

Fuel injected engines are known to provide significantly enhanced performance, power output, and emission control as compared to carbureted engines. Watercraft, however, normally do not have a neutral setting where the engine is allowed to operate without driving the propulsion device.

SUMMARY OF THE INVENTION

One aspect of the present invention includes the realization that often times the operator of a watercraft opens the throttle when starting the engine, even though the engine does not need the throttle to be opened. For example, certain known fuel injected engines can be programmed to start quickly and reliably without any manipulation of the throttle by the user. Excessive opening of the throttle during commencement can be both harmful to the various engine bearing surfaces due to low initial oil pressure and high oil viscosity. Additionally, an abrupt thrust from the propulsion unit caused by unnecessarily opening the throttle can make docking maneuvers more difficult.

Another aspect of the present invention is directed to a method of controlling engine operation during start-up in a watercraft. The method includes sensing a throttle valve angle, and determining if said throttle valve angle is larger than a predetermined throttle valve angle associated with normal engine start-up.

A further aspect of the invention is directed to a method of controlling operation of a watercraft engine during a predetermined engine speed range. The method includes sensing a throttle valve angle, and determining if the throttle valve angle is larger than a predetermined throttle valve angle associated with the predetermined engine speed range Yet another aspect of the present invention is directed to a watercraft having a hull and an engine supported by the hull. The watercraft also includes, a fuel delivery system, an ignition system, a throttle valve, and a controller configured to control operation of the fuel delivery and ignition systems. The controller is configured to at least partially disable at least one of the fuel injection system, ignition systems, and starter motor if the throttle valve is open more than a predetermined amount.

Another aspect of the invention is directed to a method of controlling operation of a watercraft engine. The method includes detecting a temperature of the engine, detecting a speed of the engine, and at least partially disabling at least one of the fuel delivery and ignition systems if the engine speed is above a predetermined speed and the temperature is below a predetermined temperature.

Yet another aspect of the invention is directed to a watercraft having a hull and an engine supported by the hull. The watercraft also includes a fuel delivery system, an ignition system, an engine speed sensor, an engine temperature sensor, and a controller configured to control operation of the fuel delivery and ignition systems. The controller is also configured to at least partially disable at least one of the fuel injection and ignition systems if a speed of the engine is higher than a predetermined speed and if a temperature of the engine is below a predetermined temperature.

BRIEF DESCRIPTION OF THE DRAWINGS

The foregoing features, aspects, and advantages of the present invention will now be described with reference to the drawings of a preferred embodiment that is intended to illustrate and not to limit the invention. The drawings comprise six figures in which.

DETAILED DESCRIPTION OF THE PREFERRED EMBODIMENT

Figure 1:
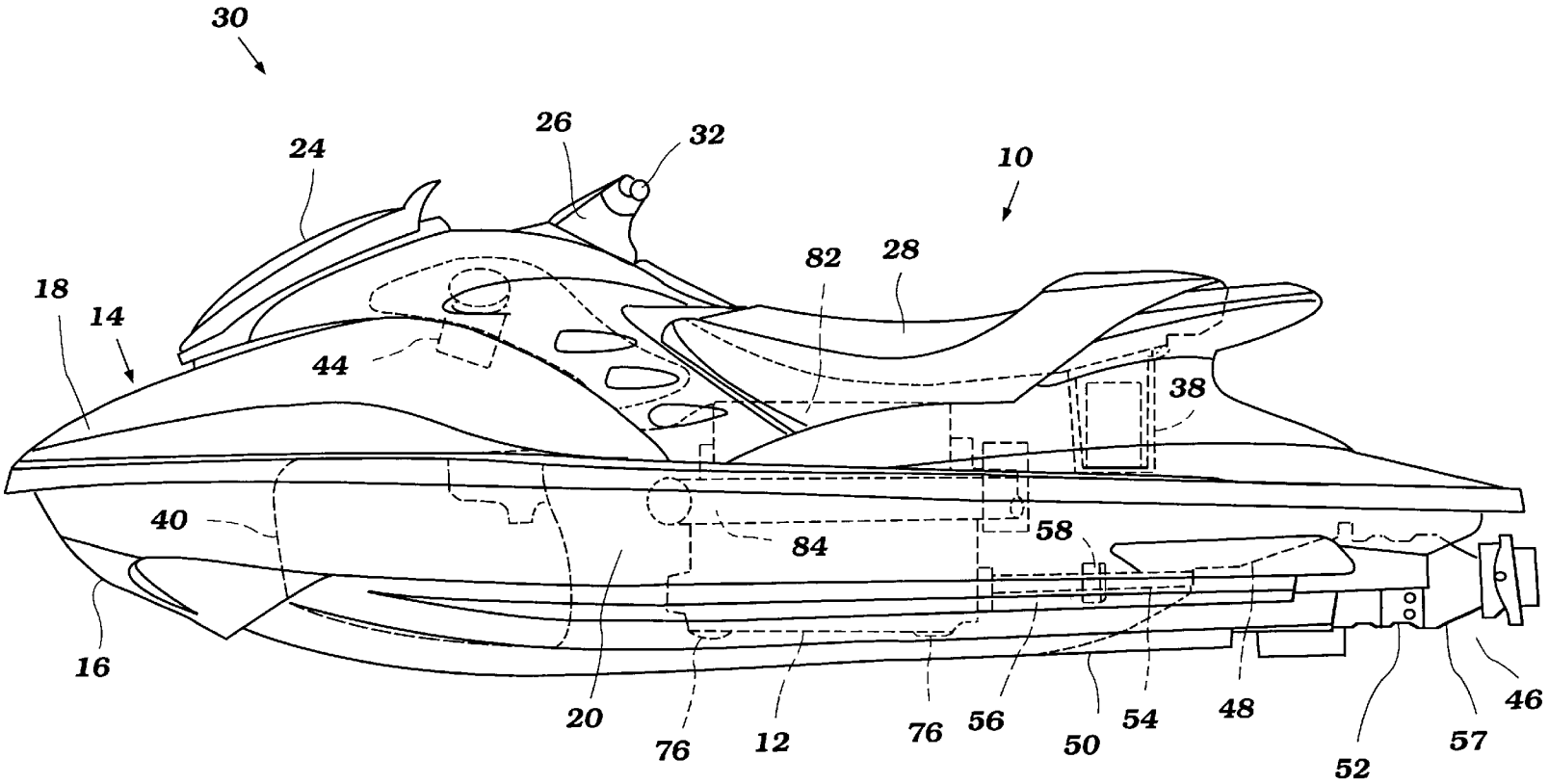
FIG. 1 is a side elevational view of a watercraft configured in accordance with a preferred embodiment of the present invention, with certain internal components including an engine shown in phantom.
Figure 2:
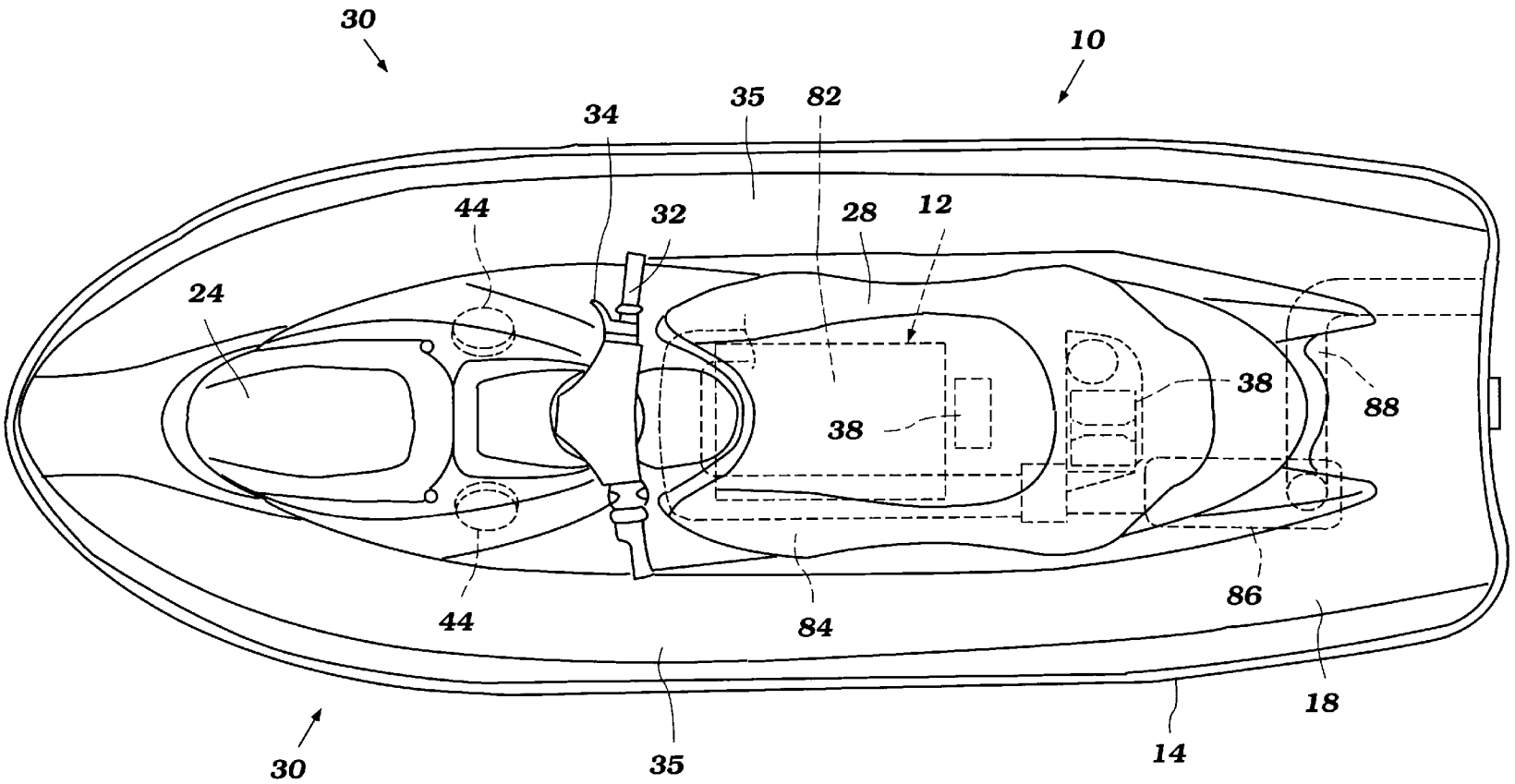
FIG. 2 is a top view of a watercraft shown in FIG. 1.
Figure 3:
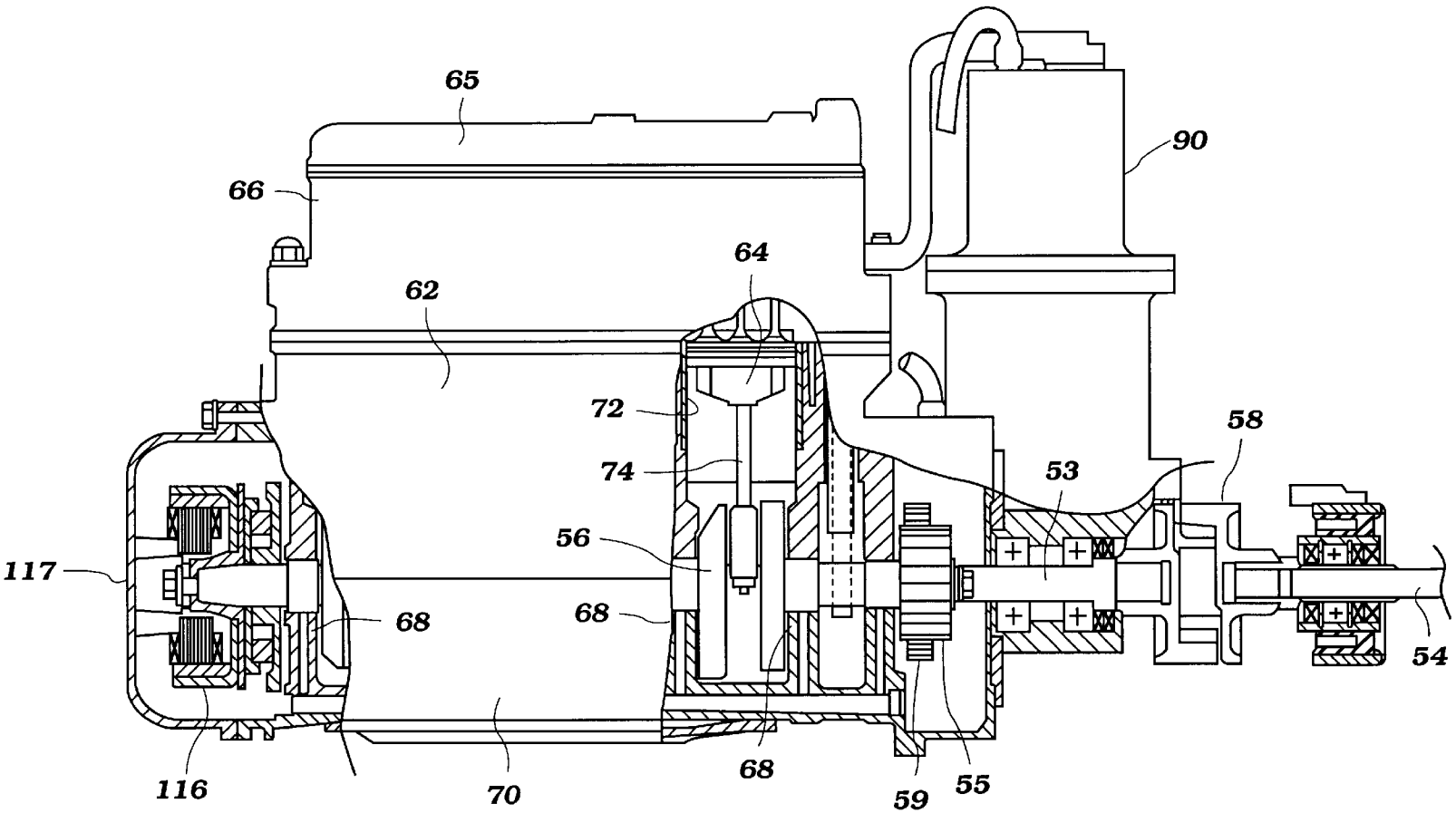
FIG. 3 is a port side elevational and partial sectional view of the engine shown in FIG. 1.

With reference to FIGS. 1 to 3, an overall configuration of a personal watercraft 10 is described below. The watercraft 10 employs an internal combustion engine 12 configured in accordance with a preferred embodiment of the present invention. The described engine configuration has particular utility with personal watercraft, and thus, is described in the context of the personal watercraft. The engine configuration, however, can be applied to other types of vehicles as well, such as, for example, small jet boats, other vehicles used with marine drives, automobiles, and other off-road vehicles.

With reference initially to FIG. 1, the personal watercraft 10 includes a hull 14 formed with a lower hull section 16 and an upper hull section or deck 18. Both the hull sections 16, 18 are made of, for example, a molded fiberglass reinforced resin or a sheet molding compound. An internal cavity 20 or "engine compartment," is defined between the lower hull section 16 and the upper hull section 18.

With reference to FIGS. 1 and 2, the upper hull section 14 preferably includes a hatch cover 24, a control mast 26 and a seat 28 arranged from fore to aft.

In the illustrated arrangement, a bow portion 30 of the upper hull section 18 slopes upwardly. An opening can be provided through the bow portion 30 so a rider can access the internal cavity 20. The hatch cover 24 can be detachably affixed (e.g., hinged) to the bow portion 30 to cover the opening.

The control mast 26 extends upwardly to support a handle bar 32. The handle bar 32 is provided primarily for controlling the direction of the watercraft 10. Grips are formed at both ends of the handle bar 32 so that the rider can hold them for that purpose. The handle bar 32 also carries other control units such as, for example, a throttle lever 34 that is used for control of the engine 12.

The seat 28 extends rearwardly from a portion just rearward of the bow portion 30. The seat 28 also generally defines a rider's area. The seat 28 has a saddle shape and hence a rider can sit on the seat 28 in a straddle-type fashion. Foot areas 35 are defined on both sides of the seat 28 along a portion of the top surface of the upper hull section 18. The foot areas 35 are formed generally flat, but may be inclined toward a suitable drain configuration. A cushion supported by the upper hull section 18, at least in principal part, forms the seat 28. The seat 28 is detachably attached to the upper hull section 18. In the illustrated embodiment, the upper hull section 18 encloses a storage box 38 that is disposed under the seat 28.

A fuel tank 40 is positioned in the cavity 20 under the bow portion 30 of the upper hull section 18. A duct (not shown) couples the fuel tank 40 with a fuel inlet port positioned at a top surface of the upper hull section 18. A closure cap (not shown) closes the fuel inlet port. The opening disposed under the hatch cover 24 is available for accessing the fuel tank 40.

The engine 12 is disposed in an engine compartment preferably located under the seat 28, but other locations are also possible (e.g., beneath the control mast or in the bow). The rider thus can access the engine 12 in the illustrated arrangement by detaching the seat 28.

A pair of air ducts or ventilation ducts 44 are provided on both sides of the bow portion 30 so that the air within the internal cavity 20 can be readily replenished or exchanged. Optionally, the watercraft 10 can include several more ventialtion ducts (not shown). Except for the ventilation ducts 44, the engine compartment 20 is substantially sealed to protect the engine 12 and other internal components from water.

A jet pump unit 46 propels the illustrated watercraft 10. Other types of marine drives can be used depending upon the application. The jet pump unit 46 preferably includes a tunnel 48 formed on the underside of the lower hull section 16. The tunnel 48 has a downward facing inlet port 50 opening toward the body of water. A jet pump housing 52 is disposed within a portion of the tunnel 48 and communicates with the inlet port 50. An impeller (not shown) is supported within the housing 52.

An impeller shaft 54 extends forwardly from the impeller and is coupled to an intermediate shaft 53 by a suitable coupling member 58. Although the impeller shaft is illustrated as one shaft, it is o be understood that the impeller shaft can be formed of several shafts (not shown).

A crankshaft 56 of the engine 12 drives a reduction gear 55 in connection with an intermediate shaft gear 59. The rear end of the housing 52 defines a discharge nozzle 57. A steering nozzle 60 is affixed to the discharge nozzle 57 for pivotal movement about a steering axis that extends generally vertically. The steering nozzle 60 is connected to the handle bar 32 by a cable or other suitable arrangement so that the rider can pivot the nozzle 60 for steering the watercraft.

As the engine 12 drives the impeller shaft 54 and hence rotates the impeller, water is drawn from the surrounding body of water through the inlet port 50. The pressure generated in the housing 52 by the impeller produces a jet of water that is discharged through the steering nozzle 60. This water jet propels the watercraft 10. The rider can move the steering nozzle 60 with the handle bar 32 when he or she desires to turn the watercraft 10 in either direction.

The engine 12 in the illustrated arrangement operates on a four-stroke cycle combustion principal. With reference to FIG. 3, the engine 12 includes an upper cylinder block 62 portion with four cylinder bores 72 formed side by side along a single plane. The engine 12, thus, is an L4 (in-line four cylinder) type. The illustrated engine, however, merely exemplifies one type of engine on which various aspects and features of the present invention can be used. Engines having a different number of cylinders, other cylinder arrangements, other cylinder orientations (e.g., upright cylinder banks, V-type, and W-type), and operating on other combustion principles (e.g., crankcase compression two-stroke, diesel, and rotary) are all practicable.

The engine 12 has pistons 64 that reciprocate in the cylinder bores 72 formed within the cylinder block 62. A valve cover 65 is affixed on top of a cylinder head member 66, which is connected to the upper end of the cylinder block 62 to close respective upper ends of the cylinder bores 72.

A lower cylinder block member 70 is affixed to the lower end of the cylinder block 62 to close the respective lower ends of the cylinder bores 72 and to define, in part a crankshaft chamber or "crankcase". The crankshaft 56 is journaled between bearings 68 in the cylinder block 62 and the lower cylinder block member 70. The crankshaft 56 is rotatably connected to the pistons 64 through connecting rods 74.

The cylinder block 62, the cylinder head member 66, and the crankcase member 70 together define an engine body of the engine 12. The engine 12 preferably is made of an aluminum based alloy. In the illustrated embodiment, the engine 12 is oriented in the engine compartment to position the crankshaft 56 generally in the longitudinal direction. Other orientations of the engine body, of course, are also possible (e.g., with a transversely or vertically oriented crankshaft).

Engine mounts 76 extend from both sides of the engine body 12. The engine mounts 76 preferably include resilient portions made of, for example, a rubber material. The engine 12 preferably is mounted on the lower hull section 16, specifically, a hull liner, by the engine mounts 76 so that vibration of the engine 12 is greatly inhibited from conducting vibration energy to the hull section 16.

An air induction system includes an air intake box 82 for smoothing intake air and acting as an intake silencer. The intake box 82 in the illustrated embodiment is generally rectangular. Other shapes of the intake box of course are possible, but it is desired to make the plenum chamber as large as possible within the space provided in the engine compartment.

The engine 12 further includes a exhaust pipe 84, which extends forwardly along a side surface of the engine 12 on the starboard side, then extends around a forward end of the engine 12 and then extends rearwardly along the port side of the engine 12. The exhaust pipe 84 is then connected to a water-lock 86 at a forward surface of the water-lock 86. With reference to FIG. 2, a discharge pipe 88 extends from a top surface of the water-lock 86 and transversely across the center plane of the watercraft 10. The discharge pipe 88 then extends rearwardly and opens at a stern of the lower hull section 16 preferably in a submerged position. Optionally, the discharge pipe 88 can terminate in a side wall of the tunnel 48. The water-lock 86 inhibits the water in the discharge pipe 88 from entering the exhaust pipe 84.

The engine 12 further includes a cooling system configured to circulate coolant into thermal communication with at least one component within the watercraft 10. Preferably, the cooling system is an open type cooling system, circulating water from the body of water in which the watercraft 10 is operating into thermal communication with heat generating components within the watercraft 10. However, other types of cooling systems can be used, such as, for example, but without limitation, closed-type liquid cooling systems using lubricated coolants and air-cooling types.

The engine 12 preferably includes a lubrication system that delivers lubricant oil to engine portions for inhibiting frictional wear of such portions. In the illustrated embodiment, a dry-sump lubrication system is employed. This system is a closed-loop type and includes an oil reservoir 90.

An oil delivery pump is provided within a circulation loop to deliver the oil in the reservoir 90 to the engine portions that are to be lubricated, for example, but without limitation, the pistons 64 and the crankshaft bearings 68. The crankshaft 56 or one of the camshafts (not shown) preferably drives the delivery pump. The crankshaft 56 or one of the camshafts also preferably drives the return pump.

The engine 12 also includes a fuel delivery system, having carburators or fuel injectors, in order to efficiently mix the correct amount of fuel and air for combustion. The main fuel supply tank 40 is part of the fuel system and is placed in the lower hull section 16 of the associated watercraft 10.

The engine 12 further includes an ignition system. Spark plugs 92 are fixed on the cylinder head assembly 66 and exposed into respective combustion chambers (not shown). The spark plugs 92 ignite an air/fuel charge during every combustion stroke, preferably under the control of an ECU 94 to ignite the air/fuel charge therein.

Figure 4:
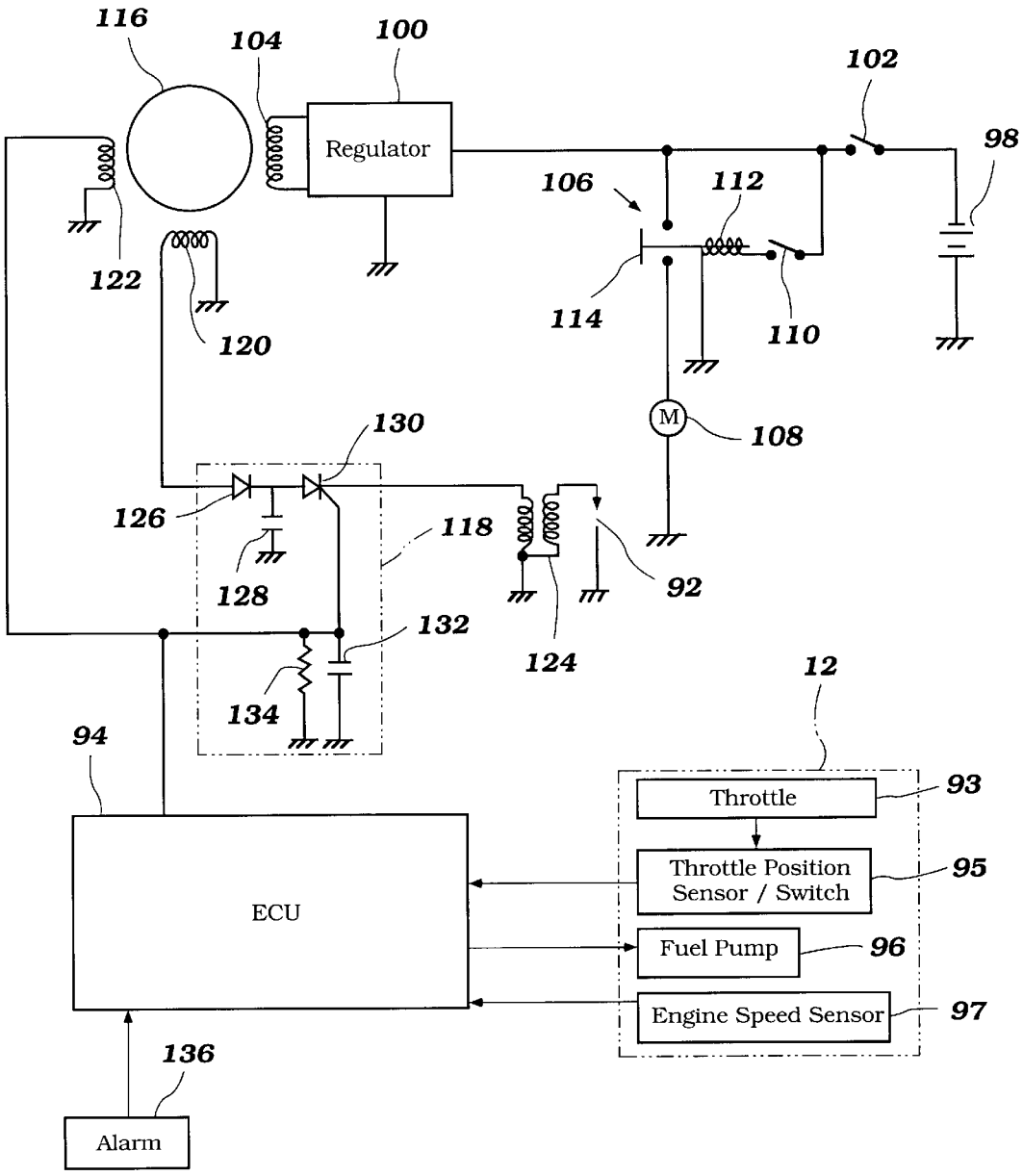
FIG. 4 is a schematic view of an engine control system including an electronic control unit, an ignition system, a starting system, configured to control the engine shown in FIG. 1.

An electrical system of the watercraft 10 is shown schematically in FIG. 4. A battery 98 is mounted in the watercraft 10, wherein the battery 98 is connected to a regulator 100 through a main switch 102. The regulator 100 is arranged to rectify an output of a battery charging coil 104 of a flywheel magneto 116 to charge the battery 98 by maintaining a predetermined voltage.

A starter relay 106 and a starter motor 108 are connected to the regulator 100 in a parallel circuit. When the main switch 102 and a starter switch 110 are closed, a relay coil 112 within the starter relay 106 is activated and a relay contact 114 is closed thereby activating the starter motor 108. When the starter motor 108 is activated the crankshaft 56 turns and the engine 12 commences.

The ECU 94 preferably is a microcomputer that includes a micro-controller having a CPU, a timer, RAM, and ROM. The ECU 94 controls engine operations including fuel injection, firing of the spark plugs 92, and operation of a fuel pump 96 according to various control maps stored in memory. In order to determine appropriate engine operation control scenarios, the ECU 94 preferably uses these control maps and/or indices stored within the ECU 94 in combination with the data collected from various input sensors. The ECU's various input sensors can include, but are not limited to, the manifold pressure sensor (not shown), a throttle position sensor 95, an engine coolant temperature sensor (not shown), an oxygen (O2) sensor (not shown), and a crankshaft speed sensor 97. The ECU 94 may refer to data collected from various sensors, for example the throttle valve position sensor 95 and other sensors provided for sensing engine running conditions, ambient conditions or other conditions of the engine 12.

As shown in FIG. 4, the ECU 94 communicates with the crankshaft speed sensor 97, the throttle position sensor 95, and the ignition system. In one arrangement, when the crankshaft speed sensor 97 measures crankshaft angle versus time, it outputs a crankshaft rotational speed signal or engine speed signal to the ECU 94. The crankshaft speed sensor 97 defines a pulse generator that produces pulses, which are, in turn, converted to an engine speed within the ECU 94 or another separate converter (not shown).

A signal from the throttle position sensor 95 measuring the angle of a throttle valve 93 is sent to the ECU 94 via a throttle position data line. The signal can be used to control various aspects of engine operation, such as for example, but without limitation, fuel injection and ignition timing. The signal from the throttle valve position sensor 95 generally corresponds to the engine load as indicated by the degree of throttle opening.

The above noted sensors correspond to merely some of the conditions which may be sensed for purposes of engine control and it is, of course, practicable to provide other sensors such as an intake air pressure sensor, intake air temperature sensor, an engine height sensor, a trim angle sensor, a knock sensor, a neutral sensor, a watercraft pitch sensor, a shift position sensor and an atmospheric temperature sensor in accordance with various control strategies. Moreover, other suitable sensors can also be used.

The electrical system also includes magnets on the flywheel magneto 116 which generate an alternating induced current in an ignition-charging coil 120. A magneto cover 117 provides protection of the flywheel magneto 116. A capacitor discharge ignition unit 118 receives the alternating induced current from the ignition charging coil 120, which is rectified by a diode 126 and charges a capacitor 128. The charged capacitor 128 is rapidly discharged through the thyristor 130 when the thyristor 130 is triggered by a ignition trigger coil 122 causing the charging capacitor 128 to complete the capacitor primary winding circuit of the ignition coil 124. The capacitor 128 then discharges through the primary winding of the ignition coil 124 causing a high voltage to be induced in the secondary winding of the ignition coil 124 which causes the spark plugs 92 to fire, igniting the mixture in the combustion chamber.

Preferably, the gate of the thyristor 130 is grounded through the trigger capacitor 132. The trigger coil 122 is connected between the trigger capacitor 132 and the gate of the thyristor 130 and a resistor 134 is connected in parallel to the trigger capacitor 132. An alarm 136 is also provided to warn the operator if the watercraft is started while the throttle valve is open more than a predetermined angle Θ.

Figure 5:
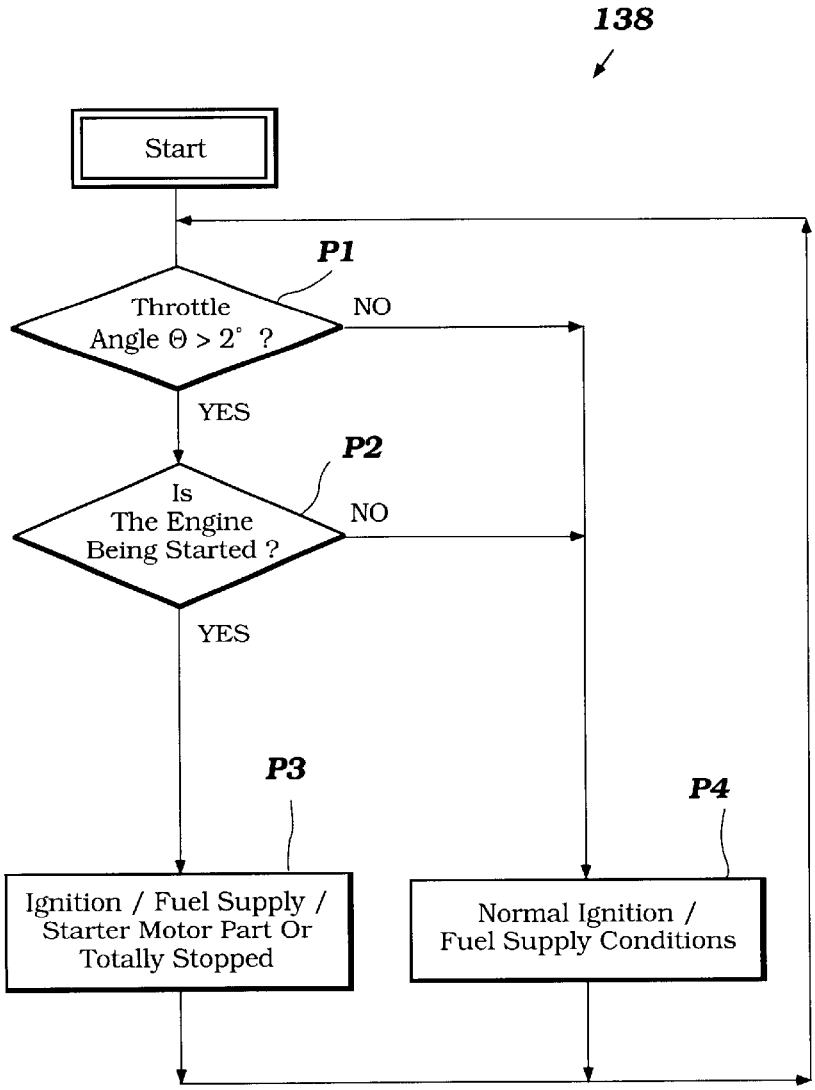
FIG. 5 is a block diagram showing a first control routine performed by the electronic control unit shown in FIG. 4.

With reference to FIG. 5, a control routine 138 is configured to control operation of the fuel injection and/or ignition systems based on the throttle valve opening and whether or not the engine is being started. As shown in FIG. 5, the routine 138 starts and then moves to decision block P1. In the illustrated embodiment, the routine 138 can start as soon as a rider attempts to start the engine 12, for example, as soon as a start button is activated. However, it is to be understood that the routine 138 can start at any time.

In the decision block P1, the throttle valve angle value Θ is compared to a predetermined throttle valve angle of 2 degrees. In the illustrated embodiment, the throttle valve is designed to allow a small amount of air to pass therethrough, so as to allow the engine 12 to operate at an idle engine speed. However, the throttle valve could be configured to be closed at idle, e.g., 0 degrees, where the induction system of the engine includes an idle air passage bypassing the throttle valve 93. Thus, the routine 138 uses 2 degrees as a predetermined throttle opening because, for the illustrated engine 12, 2 degrees encompasses an opening corresponding to idle speed operation of the engine 12, as well as a small amount to allow for normal wear of the throttle valve 93. For example, after prolonged use of the engine 12, the throttle valve 93 can become soiled. Additionally, a spring used to hold the throttle valve 93 in the closed or idle position can become worn and thus fail to fully return the throttle valve to the closed or idle position. If the throttle valve angle Θ is greater than 2 degrees, the program moves to the decision block P2.

In the decision block P2, it is determined if the engine is being started. For example, but without limitation, the ECU 94 can determine the engine speed via the engine speed sensor 97. If the engine speed is less than about 300–400 rpm, then the engine is being started. Engine speeds less than about 300–400 rpm typically corresponds to the speed attained by an engine when its crankshaft is being turned by a starter motor. Thus, when an engine speed is less than about 300–400 rpm, it can be assumed that the engine is being started. Optionally, the ECU 94 can be connected to the starter switch 110. If the starter switch 110 is being activated, then the engine is being started. If the engine is being started, then the routine 138 moves to the operation block P3.

In the operation block P3, the ignition and/or fuel system is partially or entirely stopped. For example, the ECU 94 can partially disable at least one of the fuel injection system, ignition system, or the starter motor 108. As such, the ECU 94 can limit engine speed, or completely prevent the engine 12 from starting. Preferably, the routine 138 returns to the beginning and repeats as long as the engine is running.

If, however at the decision block P1 the throttle valve angle Θ is determined to be less than 2 degrees, the program moves to operation block P4 where the ECU 94 allows for normal ignition and fuel system operation. The program then returns to the start of the control routine and repeats the forgoing steps.

Similarly, if it is determined that the engine is not being started at the decision block P2, then the routine 138 moves to operation block P4 where the ECU allows for normal ignition and fuel system operation. The program then returns to the start of the control routine and repeats the forgoing steps.

It is to be noted that the routine 138 describer above prevents a surge in engine speed, not only when a user is improperly holding the throttle open during starting, but also when the throttle valve is excessively opened due to a worn throttle return spring, or corrosion or a foreign particle preventing the throttle valve to return to the fully closed or idle speed position.

Figure 6:
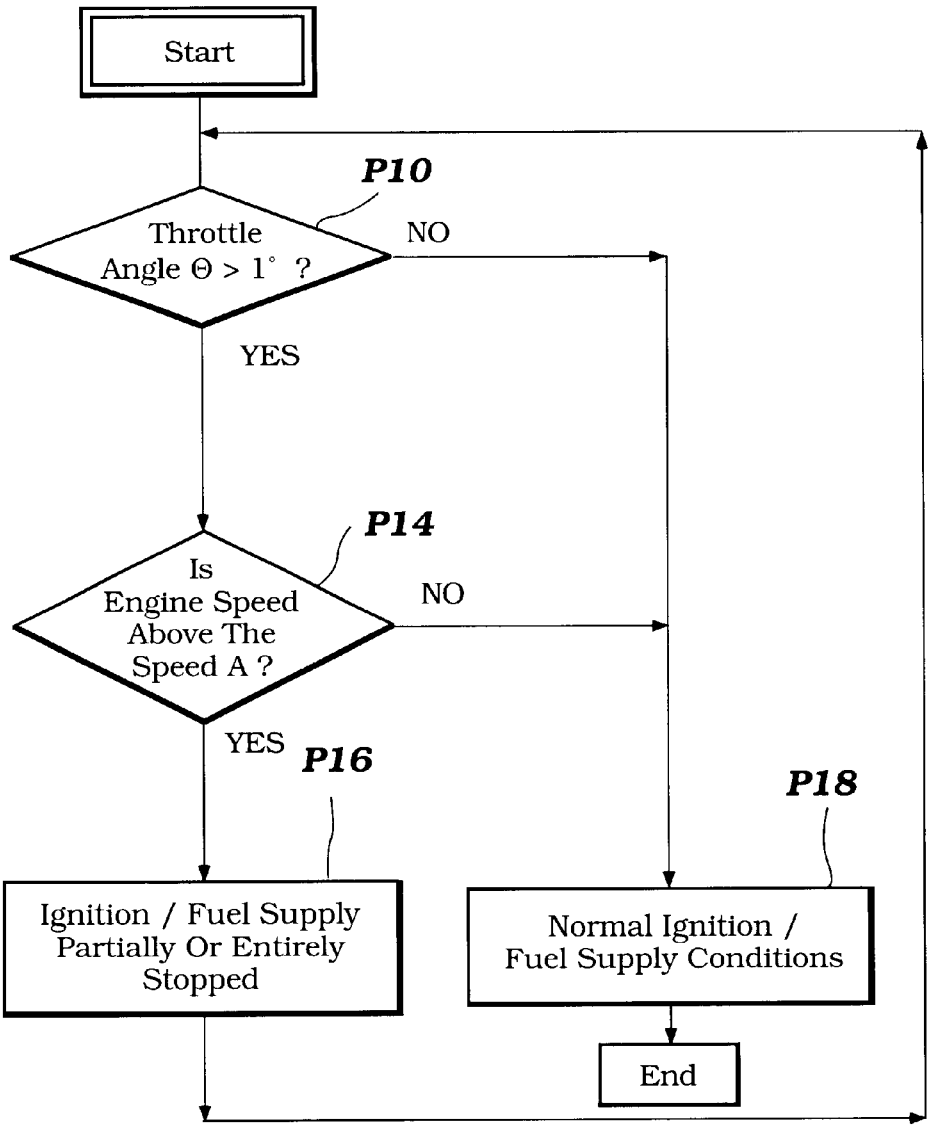
FIG. 6 is a block diagram showing a modification of the control routine shown in FIG. 5.

FIG. 6 illustrates a control routine 140 which is a modification of the routine 138 illustrated in FIG. 5. As shown in FIG. 6 the control routine 140 starts and then moves to decision block P10 where it determines if the throttle angle Θ is greater than one degree. If the throttle angle Θ is not greater than one degree, the routine 140 moves to operation block P18.

In operation block P18, the ignition and fuel systems are operated normally. For example, the ECU 94 controls the ignition and fuel systems according to any known strategy for normal operation. The program then ends returns to the start of the control routine and repeats the forgoing steps.

If in decision block P10 the throttle angle is greater than one degree, the program moves to the decision block P14, where it determines if the engine speed is above a predetermined engine speed "A". For example, the ECU 94 can sample the output of the engine speed sensor 97 and compare the sampled value to the predetermined value A. In the illustrated embodiment, the engine speed A corresponds to about 2000–3000 rpm, i.e., an appropriate upper limit engine speed for an engine that has not yet warmed to a normal operation temperature. If the engine speed is above a predetermined speed "A" then the program moves to operation block P16.

In the operation block P16, the ignition and/or fuel system is partially or entirely stopped. For example, the ECU 97 can at least partially disable the operation of the fuel injection and/or ignition systems. Preferably, the ECU 97 disables the fuel injection and/or ignition systems so as to limit the speed of the engine to approximately 2000–3000 rpm. The program returns to the start of the control routine and continues the program as long as the engine is running.

If, at the decision block P14 the engine speed is determined to be less than a predetermined engine speed "A", the routine 140 moves to operation block P18 normal ignition and fuel system operation is allowed. For example, the ECU 97 can control the ignition and fuel systems according to any known strategy for normal operation. The routine 140 then ends. Optionally, the routine 140 can return to the beginning and repeat after the control block P18. Additionally, the routine 140 can be configured to operate only when the temperature of the engine 12 is below a normal operating temperature. For example, the ECU 97 can be configured to sample an engine temperature sensor and run the routine 140 only when the engine temperature is below a normal operating temperature. Preferably, the normal operating temperature is the minimum temperature at which the engine 12 should be allowed to operate over its entire rpm range.

Thus, from the forgoing description, it should be readily apparent that the described embodiments very effectively control engine speed during a rapid deceleration state in order to prevent engine stalling. Comparing throttle angle and engine speeds in order to determine the operating condition of the watercraft accomplishes this.

Of course the forgoing description is that of preferred embodiments of the invention, and various changes and modifications may be made without departing from the spirit and scope of the invention, as defined by the appended claims.

What is claimed is:

1. A method of controlling an engine of a watercraft during start-up, the watercraft comprising a fuel injection system, an ignition system, a starter motor, and a user-operable throttle valve, the method comprising detecting an opening amount of the throttle valve, determining if the opening of the throttle valve is too large for starting the engine, disabling the starter motor if the opening is too large.

2. A method of controlling engine operation during start-up in a watercraft, the method comprising sensing a throttle valve angle, determining if said throttle valve angle is larger than a predetermined throttle valve angle associated with normal engine start-up.

3. The method of claim 2, wherein the predetermined throttle valve angle is about two degrees.

4. The method of claim 2 additionally comprising regulating the engine speed if the throttle valve angle is greater than the predetermined throttle valve angle.

5. The method of claim 2 additionally comprising disabling at least one of the fuel injection and ignition systems if the throttle valve angle is more than the predetermined throttle valve angle.

6. The method of claim 2 additionally comprising allowing normal engine operation if the throttle angle is less than the predetermined throttle valve angle.

7. The method of claim 2 additionally comprising allowing normal engine operation if the throttle angle is greater than the predetermined throttle valve angle after the engine is started.

8. A method of controlling operation of a watercraft engine having a starter motor during a predetermined engine speed range, the method comprising sensing a throttle valve angle, determining if the throttle valve angle is larger than a predetermined throttle valve angle associated with the predetermined engine speed range, and disabling the starter motor if the throttle valve angle is larger than the predetermined throttle valve angle.

9. The method of claim 8 wherein the predetermined throttle valve angle corresponds to an idle engine speed of the engine.

10. The method of claim 8 additionally comprising regulating engine speed if the throttle valve angle is greater than the predetermined throttle valve angle.

11. The method of claim 10 wherein regulating engine speed comprises disabling at least one of fuel supply and ignition.

12. The method of claim 8 further comprising alerting an operator of the watercraft if the throttle valve angle is greater than the predetermined throttle valve angle and the engine speed is within the predetermined engine speed range.

13. The method of claim 8 comprising allowing normal engine operation if the throttle angle is less than the predetermined throttle valve angle.

14. The method of claim 8 comprising allowing normal engine operation if the throttle valve angle is greater than the predetermined throttle valve angle and if the engine speed is within the predetermined engine speed range.

15. A personal watercraft comprising a hull, an engine compartment defined by the hull, an engine disposed within the engine compartment, the engine having an engine body defining at least one combustion chamber, a crankshaft rotatably journaled at least partially in the engine body, a fuel injection system configured to deliver fuel to the engine body for combustion in the combustion chamber, an ignition system configured to ignite an air/fuel charge in the combustion chamber, an induction system configured to guide air into the combustion chamber, the induction system including a throttle valve, a throttle valve position sensor configured to detect a throttle valve angle of the throttle valve, a controller configured to control operation of the fuel injection and ignition systems, a starter motor configured to rotate the crankshaft at least during start-up of the engine, the controller being configured to disable the starter motor if the throttle valve angle is greater than a predetermined angle.

16. A watercraft comprising a hull, an engine supported by the hull, the engine having a crankshaft, a fuel delivery system, an ignition system, a throttle valve, a controller configured to control operation of the fuel delivery and ignition systems, a starter configured to rotate the crankshaft, the controller being configured to disable the starter motor if the throttle valve is open more than a predetermined amount.

17. The watereraft of claim 16 wherein the predetermined amount corresponds to an idle engine speed of the engine.

18. The watereraft of claim 16 wherein the controller is configured to at least partially disable at least one of the fuel delivery and ignition systems only when the engine is being started and the throttle valve is open more than the predetermined amount.

* * * * *